US010033074B2

(12) United States Patent
Coleman

(10) Patent No.: US 10,033,074 B2
(45) Date of Patent: Jul. 24, 2018

(54) NON-CONTACTING ROTARY JOINT INCLUDING A SPACED NEAR-FIELD PROBE HAVING FIRST AND SECOND SIGNAL CAPTURE AREAS WHICH ARE DISSIMILAR AND DISCONTINUOUS

(71) Applicant: Moog Inc., East Aurora, NY (US)

(72) Inventor: Donnie S. Coleman, Dublin, VA (US)

(73) Assignee: Moog Inc., East Aurora, NY (US)

( * ) Notice: Subject to any disclaimer, the term of this patent is extended or adjusted under 35 U.S.C. 154(b) by 0 days.

(21) Appl. No.: 15/101,993

(22) PCT Filed: Dec. 9, 2014

(86) PCT No.: PCT/US2014/069244
§ 371 (c)(1),
(2) Date: Jun. 6, 2016

(87) PCT Pub. No.: WO2015/094802
PCT Pub. Date: Jun. 25, 2015

(65) Prior Publication Data

US 2016/0336630 A1 Nov. 17, 2016

Related U.S. Application Data

(60) Provisional application No. 61/917,026, filed on Dec. 17, 2013.

(51) Int. Cl.
*H01P 1/06* (2006.01)
*H01Q 9/28* (2006.01)

(52) U.S. Cl.
CPC ..... *H01P 1/062* (2013.01); *H01P 1/068* (2013.01); *H01Q 9/285* (2013.01)

(58) Field of Classification Search
CPC .. H01P 1/06; H01P 1/062; H01P 1/066; H01P 1/068; H01P 1/069
(Continued)

(56) References Cited

U.S. PATENT DOCUMENTS 4,413,646 A 11/1983 Platt et al.
5,140,696 A 8/1992 Fox
(Continued)

FOREIGN PATENT DOCUMENTS

JP H09-500513 A 4/1995

OTHER PUBLICATIONS

The International Search Report and Written Opinion of the International Searching Authority (ISR) for International (PCT) Application No. PCT/US2014/069244; Publication No. WO/2015/094802 A1; dated Mar. 18, 2015.

*Primary Examiner* — Benny Lee
(74) *Attorney, Agent, or Firm* — Harter Secrest & Emery LLP

(57) ABSTRACT

The present invention provides improved non-contacting rotary joints for the transmission of electrical signals across an interface defined between two relatively-movable members. The improved non-contacting rotary joints broadly include: a signal source (A) operatively arranged to provide a high-speed digital data output signal; a controlled-impedance differential transmission line (C) having a source gap (D) and a termination gap (E); a power divider (B) operatively arranged to receive the high-speed digital data output signal from the signal source, and to supply it to the source gap of the controlled-impedance differential line; a near-field probe (G) arranged in spaced relation to the transmission line for receiving a signal transmitted across the interface; and receiving electronics (H) operatively arranged to receive the signal received by the probe; and wherein the rotary joint exhibits an ultra-wide bandwidth frequency response capability up to 40 GHz.

6 Claims, 5 Drawing Sheets

Non-Contacting Rotary Joint ("NCRJ") System Diagram

(58) Field of Classification Search
USPC ..... 333/256, 257, 261
See application file for complete search history.

(56) References Cited

U.S. PATENT DOCUMENTS

| | | | | |
|---|---|---|---|---|
| 5,389,865 | A | 2/1995 | Jacobus et al. | |
| 5,530,424 | A * | 6/1996 | Harrison et al. | A61B 6/56 340/500 |
| 5,696,372 | A | 12/1997 | Grober et al. | |
| 5,892,411 | A | 4/1999 | Schwan et al. | |
| 6,351,626 | B1 | 2/2002 | Lohr | |
| 6,433,631 | B2 | 8/2002 | Pearson, Jr. et al. | |
| 6,437,656 | B1 | 8/2002 | Guynn et al. | |
| 6,614,848 | B2 | 9/2003 | Lohr | |
| 6,798,309 | B2 | 9/2004 | Lohr et al. | |
| 6,956,445 | B2 | 10/2005 | Coleman | |
| 7,142,071 | B2 | 11/2006 | Coleman | |
| 7,466,791 | B2 | 12/2008 | Krumme | |
| 7,559,767 | B2 | 7/2009 | Coleman et al. | |
| 7,880,569 | B2 | 2/2011 | Krumme et al. | |
| 2006/0170604 | A1 | 8/2006 | Almog et al. | |
| 2007/0040635 | A1 | 2/2007 | Popescu et al. | |
| 2009/0207087 | A1 | 8/2009 | Fang et al. | |
| 2013/0163483 | A1 | 6/2013 | Sarraf et al. | |
| 2017/0010671 | A1 | 1/2017 | Ghaffari Toiserkan | |

* cited by examiner

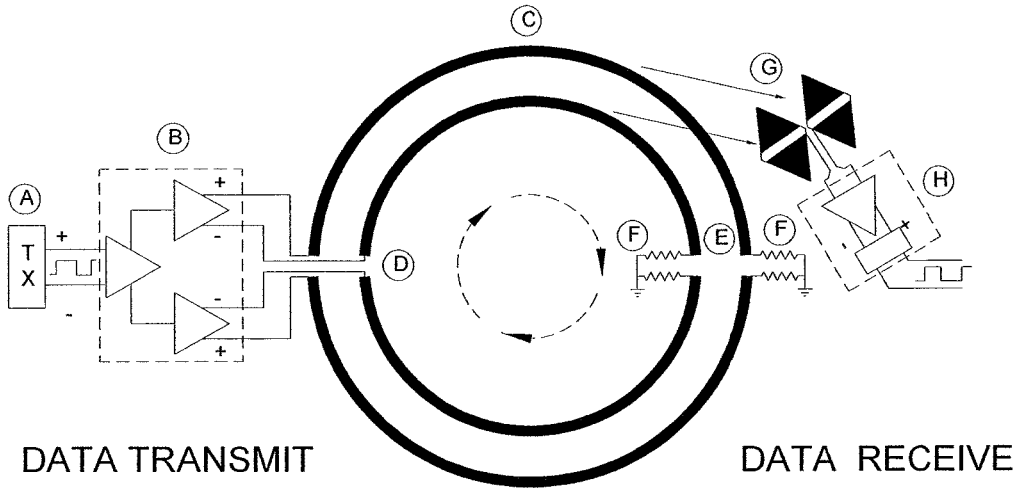
Fig. 1: Non-Contacting Rotary Joint ("NCRJ") System Diagram
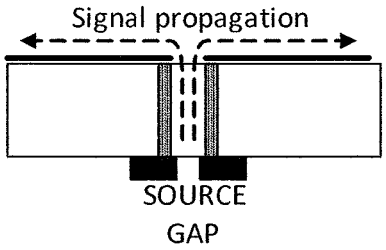
Fig. 2: RF Source Gap
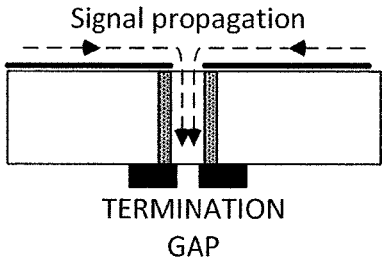
Fig. 3: RF Termination Gap

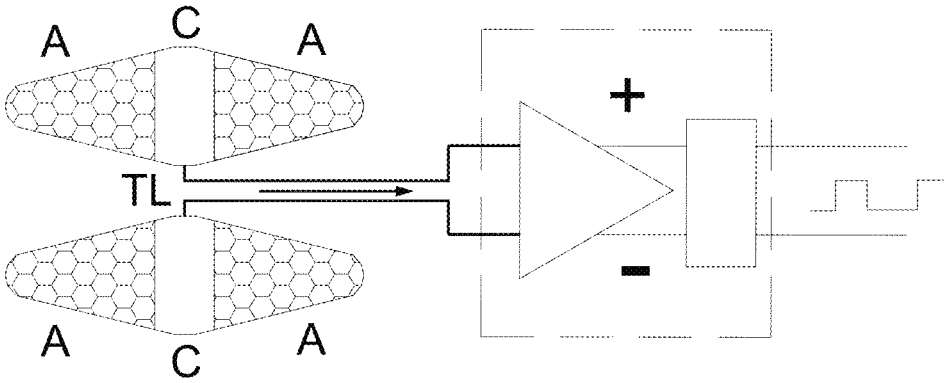
Fig. 4: Near-Field Probe With Discontinuous Geometry
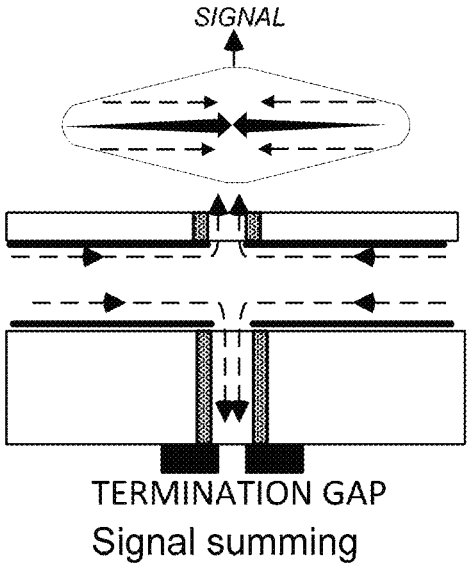
Fig. 5: Signal Summing At Rotary Joint Termination Gap
CONVENTIONAL ART

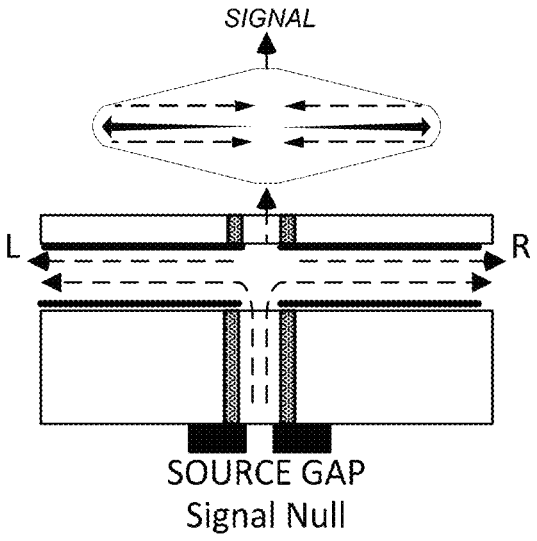
Fig. 6: Null Summing At Source Gap
CONVENTIONAL ART
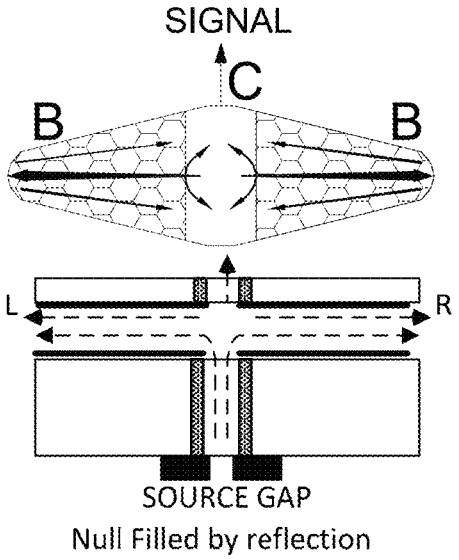
Fig. 7: Source Gap Null Filled By Local Reflection

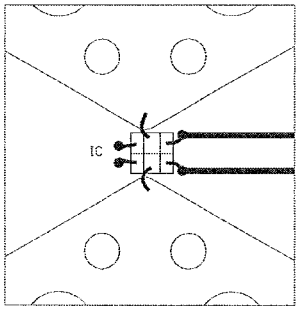
Fig. 8: IC With Wire-Bonding To Probe Structure
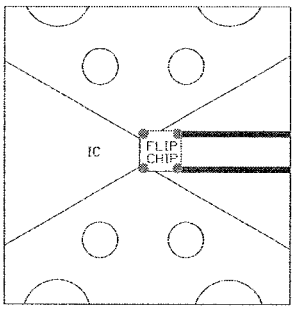
Fig. 9: Flip-Chip IC Bonded To Probe Structure

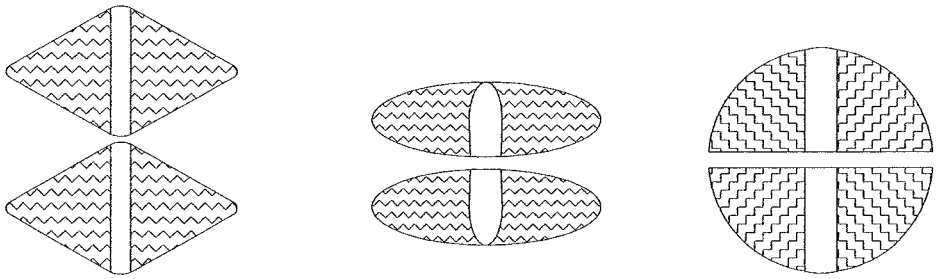
Fig. 10: Resistive Loading Incorporated Into Various Probe Structures
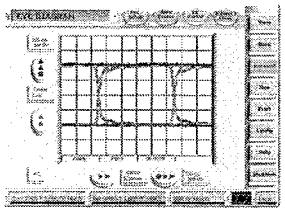
Fig. 11A: Received Eye Diagram At 1.0 Gigabits Per Second
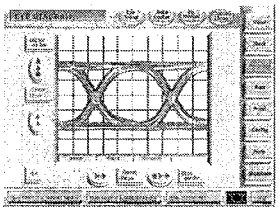
Fig. 11B: Received Eye Diagram At 7.0 Gigabits Per Second
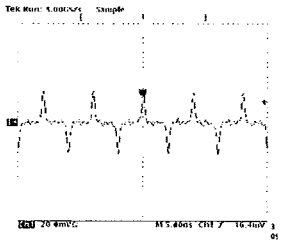
Fig. 12A: Near-Field Probe Waveform With Low-Z Detector
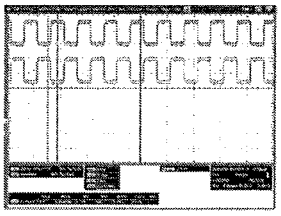
Fig. 12B: Near-Field Probe Waveform With High-Z Detector

NON-CONTACTING ROTARY JOINT INCLUDING A SPACED NEAR-FIELD PROBE HAVING FIRST AND SECOND SIGNAL CAPTURE AREAS WHICH ARE DISSIMILAR AND DISCONTINUOUS

CROSS-REFERENCE TO RELATED APPLICATION

The present application claims the benefit of the earlier filing date of provisional U.S. patent application No. 61/917,026, filed on Dec. 17, 2013.

TECHNICAL FIELD

This invention relates to improved rotary joints that enable high-speed wide-bandwidth electrical signal transmissions between two relatively-movable members (e.g., a rotor and a stator) without the use of sliding electrical contacts therebetween.

BACKGROUND ART

Devices for conducting electrical signals between two members that are rotatable relative to one another are well known in the art. Such devices, generically known as rotary joints, include slip-rings and twist capsules, inter alia. Slip-rings are typically used when unlimited rotation between the members is desired, while twist capsules are typically used when only limited rotation between the members is required.

Conventional slip-rings typically employ sliding electrical contacts between the members. These work well in most applications, but have inherent weaknesses that constrain electrical performance at higher frequencies. The physical construction of electrical contacts typically presents impedance-matching and bandwidth constraints that degrade signal integrity. In addition, sliding electrical contacts inherently generate wear debris and micro-intermittencies that complicate the recovery of data from digital signals and that negatively impact signal integrity and service life. These issues are exacerbated by fast edge-rise and fast edge-fall times of high-speed digital signals, which constrain the high-frequency performance of slip-rings.

Various techniques exist that extend the use of contact-type slip-ring technologies to higher frequencies and higher data transmission rates. These techniques are representatively shown and described in the following patents:

| Pat. No. | Title |
|---|---|
| U.S. Pat. No. 6,956,445 B2 | Broadband High-Frequency Slip Ring System |
| U.S. Pat. No. 7,142,071 B2 | Broadband High-Frequency Slip Ring System |
| U.S. Pat. No. 7,559,767 B2 | High-Frequency Drum-Style Slip-Ring Modules |
| U.S. Pat. No. 6,437,656 B1 | Broadband High Data Rate Analog And Digital Communication Link |

Contact-type slip-ring technologies exist that allow high-speed transmission of digital electrical signals at data transmission rates on the order of 10-gigabits per second ("Gbps"). However, the problems inherent in sliding electrical contacts (e.g., wear debris generation and contact lubrication issues) present long-term constraints to reliability.

The present invention enables the transmission of high-frequency electrical signals between a rotor and stator without sliding electrical contacts. The following patents disclose aspects of existing non-contacting rotary joint systems:

| Pat. No. | Title |
|---|---|
| U.S. Pat. No. 5,140,696 A | Communication System For Transmitting Data Between A Transmitting Antenna Utilizing Strip-Line Transmission Line And A Receive Antenna In Relative Movement To One Another |
| U.S. Pat. No. 6,351,626 B1 | System For Non-contacting Of Electrical Energy Or Electrical Signals |
| U.S. Pat. No. 6,433,631 B2 | RF Slipring Receiver For A Computerized Tomography System |
| U.S. Pat. No. 6,798,309 B2 | Arrangement For Transmitting Electrical Signals And/Or Energy Between Parts That Can Be Rotated In Relation To Each Other |
| U.S. Pat. No. 6,614,848 B2 | Device For Transmitting Signals Between Moving Parts |
| U.S. Pat. No. 7,466,791 B2 | Data Transmission System For Computer Tomographs |
| U.S. Pat. No. 7,880,569 B2 | Rotating Data Transmission Device |

Such non-contacting systems include devices to recover electromagnetic energy transmitted across space between a signal source and a signal receiver. In radio frequency ("RF") communications systems, such devices are called antennas (or antennae), and typically operate in the classical far-field electromagnetic radiation of free space. In contrast, the present invention provides rotary joints that utilize the electromagnetic near-field to effect electrical communications across very short distances. Devices that recover energy from the electromagnetic near-field are termed "field probes", or simply "probes".

Devices intended to function in the reactive near-field of an electromagnetic source take different forms than their far-field counterparts, with magnetic loops, voltage probes, and resistively-loaded dipoles being known in the art. Near-field applications include RF ID tags and secure low-speed data transfer, which utilize magnetic induction in the near-field. As used herein, a "probe" is a structure that operates in the near-field of an electromagnetic source, and an "antenna" is reserved for those radiation structures that are intended to be predominantly far-field devices. The subject of the present disclosure includes that of electromagnetic field probes that operate in the near-field of non-contacting rotary joints.

Conventional antennas and near-field probes exhibit a variety of behaviors that preclude or compromise their use in non-contacting rotary joint systems when operating at greater than 1 Gbps data transmission rates. Such rotary joint systems require ultra-wideband ("UWB") frequency response to pass the necessary frequency components of multi-gigabit digital data, as well as exhibiting high return loss and low distortion impulse response to preserve the time-domain characteristics of the signal. In addition, non-contacting rotary joints exhibit characteristics that complicate the design of antennas and field probes required to capture the energy transmitted across a rotary gap. Typically, non-contacting rotary joints exhibit field strength variations with rotation between the rotor and stator, exhibit directional behavior as the signals travel as waves in transmission lines from the signal source to the transmission line terminations, and may even be discontinuous in the near-field. High-frequency non-contacting rotary joints present a unique set of challenges for the design of near-field probes.

An ideal probe in an ultra-wideband non-contacting rotary joint application should meet seven criteria for successful operation at high data rates. It should:

(1) capture sufficient energy for an acceptable signal-to-noise ratio;
(2) possess bandwidth sufficient to accommodate the major frequency components of the signal;
(3) exhibit high return loss to control internal reflections and preserve signal integrity;
(4) exhibit low distortion impulse response to support good signal integrity;
(5) accommodate nulls in the transmitter pattern while delivering a stable signal;
(6) accommodate the directional responses of the rotary joint while maintaining a stable output signal; and
(7) ameliorate the probe's own directional effects while maintaining the foregoing requirements.

Conventional prior art antennas and near-field probes generally fail one or more of the foregoing requirements. Most prior art antennas and probes are narrowband standing-wave devices that lack both the frequency response and time-domain response to accommodate the wideband energy of multi-gigabit data streams. Small near-field voltage and current probes may exhibit reasonable frequency and impulse response, but lack a sufficient capture area for an acceptable signal-to-noise ratio. Modern planar patch and bowtie UWB antennas exhibit most of the desirable characteristics for a near-field probe, but, like other prior art antennas and probes, do not inherently address the directional characteristics of non-contacting rotary joints, while simultaneously contending with nulls or discontinuities in the radiation pattern. Further, most antennas and near-probes exhibit directional behaviors of their own at high frequencies. This directional coupler effect further compounds the problems associated with the directionality of non-contacting rotary joints. The combination of effects described above is manifested as variations in signal output from typical near-field probes, can exceed 20 dB, and can present significant challenges for signal recovery.

Addressing all of these requirements simultaneously is the subject of the present invention. The present invention expands the art and addresses the shortcomings of prior rotary joint solutions. The present invention exhibits the following characteristics, and provides:

(1) a high-speed rotary joint, with no electrical contacts in the signal path; and
(2) that ameliorates the directional characteristic of frequency probes and antennas at high frequencies; and
(3) that accommodates a discontinuous field response (nulls) in rotary joints; and
(4) that possesses a good capture area for a high signal-to-noise ratio; and
(5) that has acceptable return loss; and
(6) that exhibits an ultra-wide bandwidth frequency response up to 40 GHz; and
(7) is capable of supporting data transmission rates of greater than 10 gigabits per second.

SUMMARY OF THE INVENTION

With parenthetical reference to the corresponding parts, portions or surfaces of the disclosed embodiment, merely for purposes of illustration and not by way of limitation, the present invention provides improved non-contacting rotary joints for the transmission of electrical signals across an interface defined between two relatively-movable members. The improved non-contacting rotary joints broadly include: a signal source (A) operatively arranged to provide a high-speed digital data output signal; a controlled-impedance differential transmission line (C) having a source gap (D) and a termination gap (E); power divider (B) operatively arranged to receive the high-speed digital data output signal from the signal source, and to supply the high-speed digital data output signal to the source gap of the controlled-impedance differential line; a near-field probe (G) arranged in spaced relation to the transmission line for receiving a signal transmitted across the interface; and receiving electronics (H) operatively arranged to receive the signal received by the probe; and wherein the rotary joint exhibits an ultra-wide bandwidth frequency response capability of up to 40 GHz.

The improved joints may further include a printed circuit board, and the power divider may be embedded in the printed circuit board.

The improved joints may further include a printed circuit board, and the transmission line may have at least one termination that is embedded in the printed circuit board.

The improved joints may be capable of supporting data transmission rates in excess of 10 Gbps.

The probe may be suspended at a distance over the transmission line.

The near-field probe may include discontinuous geometry within a patterned geometry, and such geometry may be either deterministic (i.e., nonrandom or derived from a repeatable algorithmic or mathematical procedure) or non-deterministic (i.e., random).

The near-field probe may have a portion that is planar.

Accordingly, the general object of the invention is to provide improved non-contacting rotary joints for the transmission of electrical signals across an interface defined between two relatively-movable members.

Another object is to provide (1) a high-speed rotary joints, with no electrical contacts in the signal path; and (2) that ameliorate the directional characteristic of frequency probes and antennas at high frequencies; and (3) that accommodate a discontinuous field response (nulls) in rotary joints; and (4) that possess a good capture area for a high signal-to-noise ratio; and (5) that have acceptable return loss; and (6) that exhibit an ultra-wide bandwidth frequency response up to 40 GHz; and (7) that are capable of supporting data transmission rates of up to greater than 10gigabits per second.

These and other objects and advantages will become apparent from the foregoing and ongoing written specification, the drawings, and the appended claims.

BRIEF DESCRIPTION OF THE DRAWINGS

FIG. 1 is a schematic view of an improved non-contacting rotary joint and in particular shows a Non-Contacting Rotary Joint ("NCRJ") System Diagram for transmission of a transmitter (TX) signal from a DATA TRANSMIT side to a DATA RECEIVE side. Conventional positive (+) and negative (−) symbols are shown to denote differential signaling and transmission lines.

FIG. 2 is a schematic view of an RF transmission source gap.

FIG. 3 is a schematic view of an RF transmission line termination gap.

FIG. 4 is a schematic view of a near-field probe with discontinuous geometry and transmission lines (TL) to receiving electronics. Conventional positive (+) and negative (−) symbols are shown to denote differential signaling and transmission lines.

FIG. 5 is a schematic view of signal summing at the termination gap.

FIG. 6 is a schematic view of null signal summing at the source gap with left (L) and right (R) orientations.

FIG. 7 illustrates a source gap null filled by local reflection with left (L) and right (R) orientations.

FIG. 8 illustrates wire-bonding of an integrated circuit ("IC") to a probe structure.

FIG. 9 illustrates a flip-chip IC bonded to probe structure.

FIG. 10 illustrates several forms of resistive material loading incorporated into a variety of probe structures.

FIG. 11A is a view of a received eye diagram at 1.0 gigabits per second.

FIG. 11B is a view of a received eye diagram at 7.0 gigabits per second.

FIG. 12A is a plot of near-field probe waveforms with a low-Z detector.

FIG. 12B is a plot of near-field probe waveforms with a high-Z detector.

DETAILED DESCRIPTION OF THE PREFERRED EMBODIMENTS

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part.

Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

This invention provides, in one aspect, a non-contacting rotary joint ("NCRJ") that is based upon a high-speed data link ("HSDL"), such as disclosed in U.S. Pat. No. 6,437,656 B1, and can be considered an improvement to the structure described therein. The improvement expands the prior art HSDL technique to include the transmission of high-speed data signals across an intervening interface between two relatively movable members, without the use of sliding electrical contacts in the signal path. The invention includes a split differential microstrip transmission line driven by a signal source through a power divider and resistively terminated at the far end, and a receiver that includes a planar differential field probe that senses the near-field of the transmitter differential microstrip and that delivers recovered signal energy to an electronic receiver for detection. The differential near-field probe has an ultra-wideband response to optimize capture area, bandwidth, impedance, return loss, and transient response in the near-field, while canceling radiation to the far-field. The near-field probe operates essentially as a Hertzian dipole below a few gigahertz, and as a traveling-wave probe at centimeter wavelengths. The present invention provides a high-speed non-contacting rotary joint ("HS-NCRJ") that can be implemented with printed circuit board ("PCB") technology, and that can support multi-gigabit data transmission rates, with frequency-domain bandwidths of up to 40 gigahertz ("GHz").

The characteristics of the near-field probe accommodate the various problematic characteristics of the non-contacting rotary joint, including the directional and discontinuous nature of the near-field response. The probe employs the use of dissimilar geometries to produce several effects that benefit operations in a non-contacting rotary joint, including:

(1) deliberate signal reflection near the probe feed point;

(2) increased bandwidth through reactive loading; and (3) increased return loss through reactive and/or resistive loading.

Dissimilar geometry in selected portions of the probe ameliorates the discontinuous field properties of the data transmission line by deliberately inducing a signal reflection within the probe. FIG. 1 illustrates the nature of the non-contacting rotary joint as a system diagram.

In FIG. 1, signal source (A) serves to deliver a high-speed digital data signal to a power divider (B) (which can be active or passive), where the signal transits through source gap (D) and into a controlled-impedance differential transmission line (C). The signal then propagates as a transverse electromagnetic wave ("TEM") on the differential transmission line ring structure to where the signal is terminated at the far-end termination gap (E) by wideband termination techniques (F). The TEM signal travelling on the ring transmission line is sampled in the near-field by an ultra-wideband planar near-field probe (G), which is suspended at some distance over the ring structure to allow free rotation of the rotary joint, without physical contact. Thus, as shown, probe (G) is suspended at a distance over controlled-impedance differential transmission line (C). The signal recovered by the near-field probe is delivered to the receiver (H), where the signal can be detected, amplified, and its data recovered. The operation of the individual elements is described and illustrated below.

Data Source Driver and Power Divider

The data source driver (A) can be any of a number of technologies capable of the desired data rate, including a current-mode logic ("CML"), a field-programmable gate array ("FPGA"), a low-voltage differential signaling ("LVDS") device, and other discrete devices. The data signal is be divided into two equal-amplitude phase-inverted signals for feeding the differential ring system, a function that can be done by passive resistive dividers or by active techniques (e.g., CML fan-out buffer). For example, a 1:2 fan-out buffer can drive a single data channel, while a larger-order fan-out buffer can drive multiple redundant channels for high reliability applications. Single-ended operation of the non-contacting rotary joint is also possible, albeit foregoing the advantages of differential signaling. The power divider can be implemented as a discrete assembly, or incorporated onto PCB structures with discrete or integrated components, or embedded passive components implemented in planar PCB geometry. The technology employed to implement the power divider imposes a constraint to high frequency operation of the data channel due to parasitic reactances of the component package introducing signal reflections that become progressively more pronounced at higher frequencies. The driving electronics, power divider, and transmission line terminations can be implemented using a variety of technologies (e.g., thru-hole or surface mount components on PCB structures, integrated components, or embedded passive components implemented in planar PCB geometry), with high frequency performance capabilities determined by decreasing parasitic reactances. The following table summarizes the general operational capabilities of the various technologies.

| Technology | Approximate Frequency Limit |
|---|---|
| Thru-hole components | 100 MHz |
| Surface-mount technology | 10 GHz |
| Integrated components | 15 GHz |
| Embedded planar devices | >20 GHz |

Controlled-Impedance Differential Transmission Line Ring System

The ring system in the non-contacting rotary joint is a controlled-impedance differential transmission line that is non-resonant, discontinuous, and typically implemented in microstrip multilayer printed circuit board technology. The nature of the ring transmission line is such that the bulk of the signal energy is contained in the near-field of the conductors. Energy radiated from the structure tends to cancel in the far-field, an aid to electromagnetic interference (EMI) suppression. The propagating signal on the ring system has directional properties, as shown in FIGS. 2 and 3. This is an important factor for the design of the near-field probe.

Near-Field Probe

The near-field probe (G) is a planar structure that is designed to have an ultra-wideband near-field response, while meeting the specific requirements of the high-speed data transmission on the ring transmission line. Specifically, the near-field probe must: (a) have an adequate capture area to recover sufficient energy for signal detection, (b) have adequate bandwidth sufficient for at least the third harmonic of the data stream, (c) have an output impedance appropriate to a signal detector, (d) have a high return loss, (e) have near-field properties that accommodate the non-uniform field response of the ring, (f) have a good impulse response, and (g) that ameliorate the directional signal properties of both the rotary joint and the probe itself.

FIG. 4 illustrates the concept of a wideband probe design capable of operating at data rates of several gigabits per second and addressing the several challenges inherent in non-contacting rotary joints. The triangular portions shown as "A" in FIG. 4 are planar elements of the near-field probes. The actual shape of the probe elements can take many forms that are dependent upon the physical and electrical requirements of the specific application. In this example, the geometries shown as items "A" and "C" are dissimilar and are part of the solution to the discontinuous near-field response of a non-contacting rotary joint.

To understand the functioning of the probe, an example of a conventional near-field probe is presented in FIGS. 5 and 6 as a way of demonstrating the effects. FIG. 5 illustrates the example of transmitter signal flow in the transmission line in the lower portion of the figure. The received signal flow within the probe is shown in the upper part of the figure.

At higher frequencies, the near-field probe exhibits directional properties similar to a traveling-wave antenna, in which the strength of the induced signal increases as the signal propagates along the structure. In FIG. 5, the solid tapered lines with inwardly-directed arrows denotes the induced signals, with the signal level increasing in response to the data signal traveling on the transmission line. In the case where the probe is positioned over the termination gap, the two signals induced in the probe and traveling in opposite directions and arrive at the probe feed point and combine in-phase and delivered as the signal output from the probe. When the probe is located away from termination gap, the bi-directional response of the probe allows signals to be received from either direction on either side of the termination gap, albeit with somewhat reduced signal amplitude.

FIG. 5 also shows other signals present in the probe, shown by dashed lines with arrows, denoting the reflections internal to the probe that result from the induced signals reaching the ends of the probe and reflecting from the impedance discontinuity. These reflected signals reverberate across the probe multiple times with decreasing amplitude due to a number of effects influencing the return loss of the probe. The reflections constitute an unwanted signal that interferes with the desired direct signal, arriving at the feed point with lower amplitude and displaced in time. These internal reflections are among the effects that limit the data rate of non-contacting rotary joints.

FIG. 6 illustrates another problematic effect that occurs in non-contacting rotary joints when the transmitter source gap is positioned directly under the field probe. When directly over the source, the energy received by the probe is propagating away from the source (outwardly-directed solid arrows) and not toward the probe feedpoint, producing little signal output—a null in the probe response. The induced travelling wave signals propagating along the probe are reflected off impedance discontinuity at the end of the probe then travel toward the probe feedpoint (inwardly-directed dotted arrows) and repeatedly reverberate across the probe.

The signals reflected from the impedance change at the probe ends partly fill the null in the probe output, but are displaced in time. The result is low signal amplitude and temporal distortion that complicate data recovery. An automatic gain control is a prior art solution to the partial null, but the temporal distortion from the reflection is a major constraint to the data rate. This invention corrects all these deficiencies, and supports much faster data transmission rates.

FIG. 7 illustrates the mechanism by which the present invention remedies the problematic case of the transmitter source gap by the use of discontinuous geometry.

The deliberate creation of a signal reflection from a region on the probe that is some distance removed from the center provides signal energy to fill the null that would otherwise result. The proximity of the reflection site to the signal output produces minimal temporal distortion and fills the null, thus remedying two of the constraints to data transmission rate. Changing the surge impedance of the probe at the transition from region "C" to region "B" in FIG. 7 creates such a reflection, as shown by the central curved arrows in FIG. 7. The impedance change can be accomplished in region "B" in varying degrees by application of a solder mask, a change in cross-section by plating or solder coating, or by introducing a geometry change, such as geometric pattern regions, as illustrated in FIG. 7.

Introducing a change of geometry in the probe changes the surge impedance and gives the desired reflection, but such geometric structures also serve as distributed loading to increase the bandwidth and return loss of the system. The example of FIG. 7 illustrates the use of a mesh that serves to introduce multiple resonances that provide the bandwidth expansion, as well as an increase in return loss. The increased return loss attenuates the reflection of the signal from the probe ends and reduces the amplitude of the reflected signal that would otherwise reverberate across the probe and constitute an interfering signal to the desired signal. Continuous resistive loading can also be used to create the desired reflection, as well as increasing the return loss, but does not offer the advantage of bandwidth increase.

Geometric patterns can be implemented as holes in planar metal structures or as linear or curved features, such as shown in FIG. 7, both of which serve to create new resonances in the pass-band of the probe. The frequency of resonance and the impedance of the structure are functions of the probe geometry, which can be implemented to provide the desired characteristics, such as selectively providing resonances at the desired even and odd harmonics of a high-speed data stream.

Fractal geometry can also be utilized as a pattern in a near-field probe. Fractal geometry has the advantage of providing deterministic algorithms for the creation of physical geometry, but with the disadvantage of providing relatively little control of the resulting pass-band resonances. The resonances in fractal structures tend to have a logarithmic relationship that is less supportive of the harmonics of a high-speed data signal.

The current state of the art does not permit closed form design practices for discontinuous geometries, but electromagnetic simulation can be used to optimize the size, shape, number, and placement of geometric features, apertures, discontinuities, and other structures for optimal return loss and frequency response of a non-contacting rotary joint system.

The ultimate high-frequency performance of the near-field probe and differential amplifier of the receiving electronics is partly constrained by the transmission line connecting the probe and amplifier together as shown in FIG. 4. The impedance of the probe and the input impedance of the amplifier are frequency dependent, vary independently of one another, and can only approximate the characteristic impedance of the transmission line connecting them. At frequencies where the impedances of the probe and the amplifier are different than the characteristic impedance of the transmission line, there will be an impedance transformation that can exacerbate impedance mismatches and adversely affect the frequency response of the system. The effect is strongest at frequencies where the electrical length of the connecting transmission line is an odd multiple of a quarter-wavelength. Shortening the transmission line improves frequency response by increasing the frequency where these impedance inversion effects are pronounced. The ultimate high-frequency performance is achieved when the interconnections between the probe and electronics are shortened to the shortest practical physical dimensions, such as by utilizing flip-chip devices or wire-bonded integrated circuits directly into the probe structure. Wire bond interconnections and flip-chip packaging and, as shown in FIGS. 8 and 9, respectively, followed by encapsulation or other passivation technique, can extend the bandwidth of the probe system to as high as 60-GHz (i.e., a wavelength of five millimeters.

The geometry of a near-field probe is flexible and many variants are possible, depending upon the specific application and the bandwidth requirements of the chosen transmission type. Near-field probes can assume a variety of shapes, including diamonds, circular, triangular, tapered, curved, rectilinear, or other form to complement the physical form of the transmission line. Similarly, patterns of apertures or features within the probe to implement reactive loading to enhance bandwidth and return loss, can utilize any type of geometry, are not constrained by conventional deterministic geometric forms, but can use discontinuous geometries of any form, including random or arbitrary forms, to provide for the operational requirements of the specific signal type and the specific rotary joint transmission line characteristics. Additionally, the reactive loading of patterned geometries can be augmented or replaced by the use of continuous resistive loading materials in the construction of the field probe. Resistive materials, such as nickel alloys and tantalum nitride, can improve return loss and time domain response by attenuating reflections from the extremes of the field probe. FIG. 10 illustrates the use of a resistive conductive layer incorporated into a variety of probe structures, with or without the use of geometric patterning. Again, the actual shape of a near-field probe can take many forms, as appropriate for the particulars of the application. The presence of the quasi-linear regions shown function in a manner as previously described, introducing deliberate local reflections to ameliorate the discontinuous fields and directionality encountered in a rotary joint application.

Test Data

The following data are presented to demonstrate various performance aspects of invention operating in a noncontacting rotary joint, beginning with the eye diagrams shown in FIGS. 11A and 11B. Eye diagrams are a standard technique for evaluating the performance of a digital data system. FIG. 11A illustrates the very good signal integrity of the prototype operating at 1.0 gigabits per second, and FIG. 11B shows very good signal integrity of the prototype operating at 7.0 gigabits per second. The system performance is limited by the bandwidth of the electronics.

FIGS. 12A and 12B illustrate the signals received from the near-field probe by low-impedance and high-impedance amplifiers, respectively. The data shown in FIGS. 11A and 11B, and FIGS. 12A and 12B illustrate the high-frequency performance of the non-contacting rotary joint using the a planar near-field probe with discontinuous geometry.

Therefore, the present invention provides improved non-contacting rotary joints for the transmission of electrical signals across an interface defined between two relatively-movable members. The improved non-contacting rotary joints broadly include: a signal source (A) operatively arranged to provide a high-speed digital data output signal; a controlled-impedance differential transmission line (C) having a source gap (D) and a termination gap (E); a power divider (B) operatively arranged to receive the high-speed digital data output signal from the signal source, and to supply it to the source gap of the controlled-impedance differential line; a near-field probe (G) arranged in spaced relation to the transmission line for receiving a signal transmitted across the interface; and receiving electronics (H) operatively arranged to receive the signal received by the probe; and wherein the rotary joint exhibits an ultra-wide bandwidth frequency response capability up to 40 GHz.

The present invention contemplates that various changes and modifications may be made without departing from the spirit of the invention, as defined and differentiated by the following claims.

What is claimed is:

1. A non-contacting rotary joint for transmission of electrical signals across an interface defined between two relatively-movable members, comprising:

a signal source (A) operatively arranged to provide a high-speed digital data output signal;

a controlled-impedance differential transmission line (C) having a source gap (D) and a termination gap (E);

a power divider (B) operatively arranged to receive said high-speed digital data output signal from said signal source, and to supply said high-speed digital data output signal from said signal source to said source gap of said controlled-impedance differential transmission line;

a near-field probe (G) arranged in spaced relation to said controlled-impedance differential transmission line for receiving a signal transmitted across said interface;

said near-field probe having a signal capture area for receiving said signal transmitted across said interface;

said signal capture area having a first region and a second region, said first and second regions having dissimilar geometries, such that said signal capture area has a discontinuous geometry; and receiving electronics (H) operatively arranged to receive the signal received by said near-field probe; and wherein said rotary joint exhibits an ultra-wide bandwidth frequency response capable of high speed data transmission rates.

2. A non-contacting rotary joint as set forth in claim 1, wherein said first region of said signal capture area of said near-field probe is planar.

3. A non-contacting rotary joint as set forth in claim 1, and further comprising an integrated circuit, and wherein said transmission line has at least one termination that is embedded in said integrated circuit.

4. A non-contacting rotary joint as set forth in claim 1, wherein said high speed data transmission rates are in excess of 10 Gbps.

5. A non-contacting rotary joint as set forth in claim 1, wherein said probe is suspended at a distance over said controlled-impedance differential transmission line.

6. A non-contacting rotary joint as set forth in claim 1, wherein said first region of said signal capture area of said near-field probe has a first geometric pattern and said second region of said signal capture area of said near-field probe has a second geometric pattern dissimilar to said first geometric pattern of said first region.

* * * * *